US005899910A

United States Patent [19]

Etman

[11] Patent Number: 5,899,910

[45] Date of Patent: May 4, 1999

[54] DIRECT ACTING CAM GRIPPING MECHANISM

[76] Inventor: Sameer A. Etman, 1726 Rollin St., So. Pasadena, Calif. 91030

[21] Appl. No.: 08/715,181

[22] Filed: Sep. 17, 1996

[51] Int. Cl.[6] ..... A61B 17/50

[52] U.S. Cl. ..... 606/133; 606/210

[58] Field of Search ..... 452/88, 100; 606/131, 606/133, 205–210

[56] References Cited

U.S. PATENT DOCUMENTS 2,592,484 4/1952 Smith ..... 606/133
5,108,409 4/1992 Demeester ..... 606/133
5,176,690 1/1993 Gross et al. ..... 606/131
5,217,469 6/1993 Dolev ..... 606/133

*Primary Examiner*—Glenn K. Dawson
*Attorney, Agent, or Firm*—William W. Haefliger

[57] ABSTRACT

A gripping mechanism has a rotating cam directly acting upon at least one cam follower plate in such a manner that the rotating cam provides reciprocating motion up and down to and from an operating surface, sweeping forward motion along the operating surface, and a lateral actuating force that, in cooperation with at least one actuating surface, opens a pair of gripping surfaces while approaching the operating surface, and close same gripping surfaces prior to lifting away from the operating surface.

19 Claims, 10 Drawing Sheets

FIG. 5.
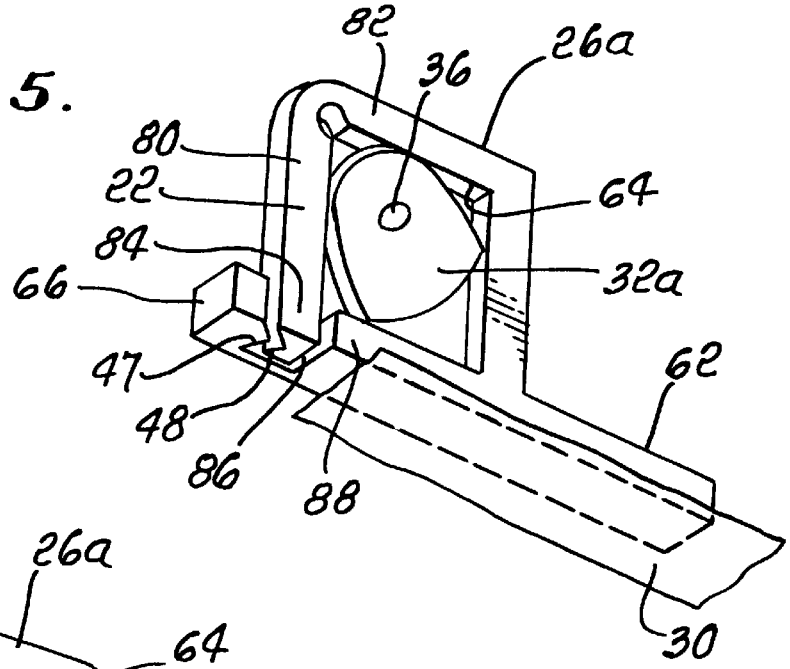
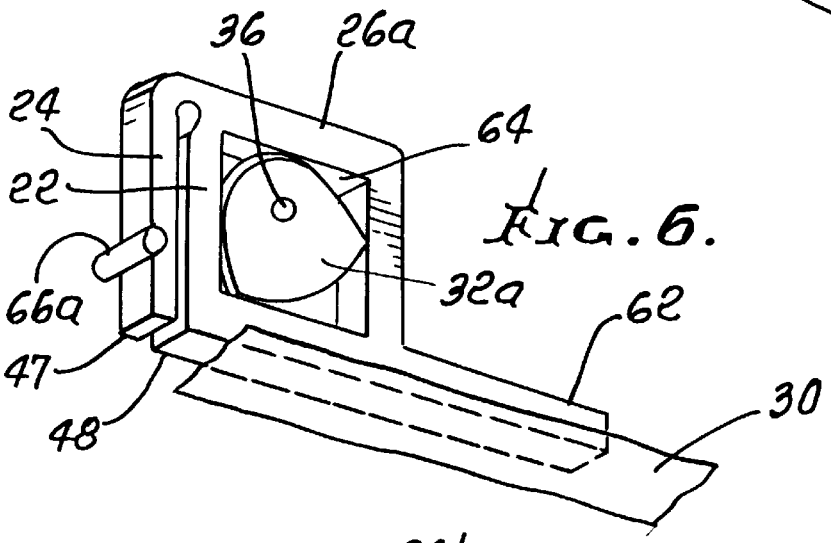
FIG. 6.
FIG. 7.
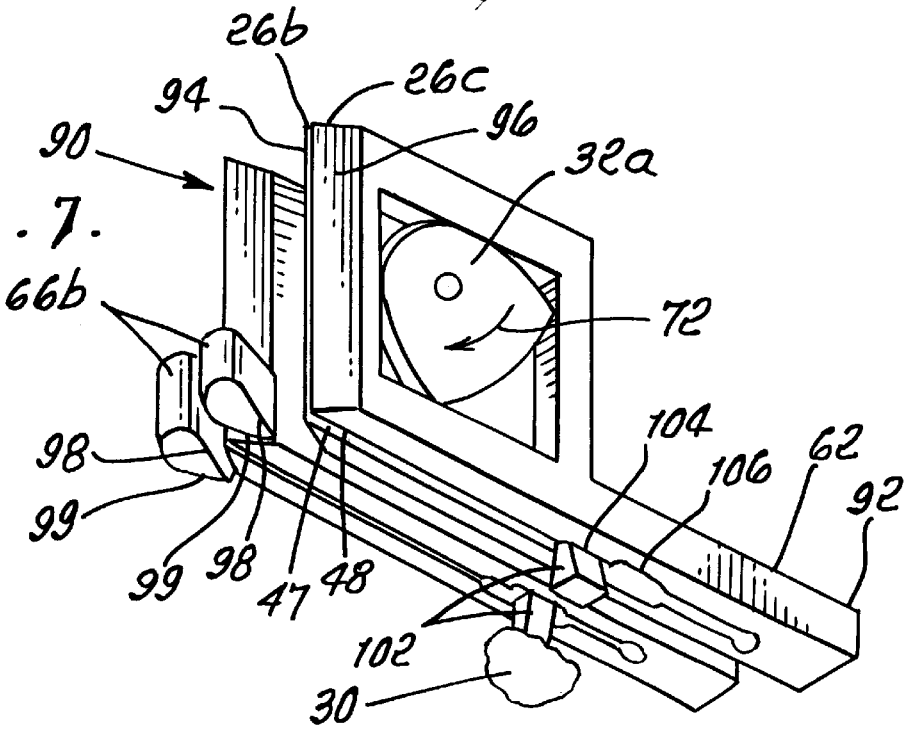

FIG. 8e.
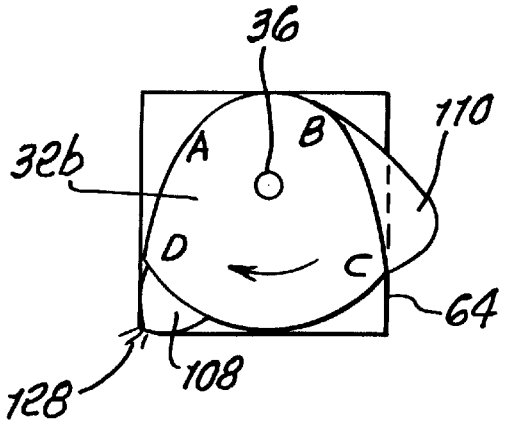
FIG. 8f.
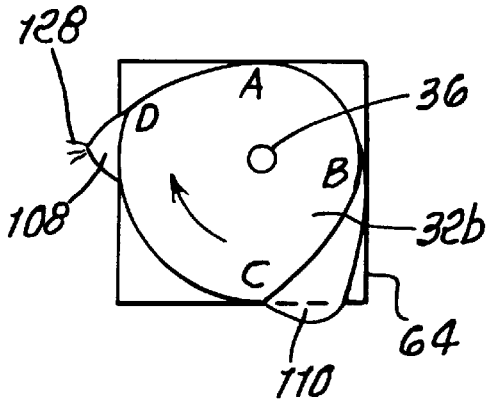
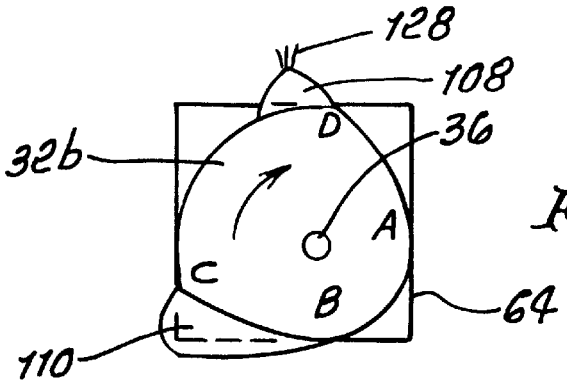
FIG. 8g.
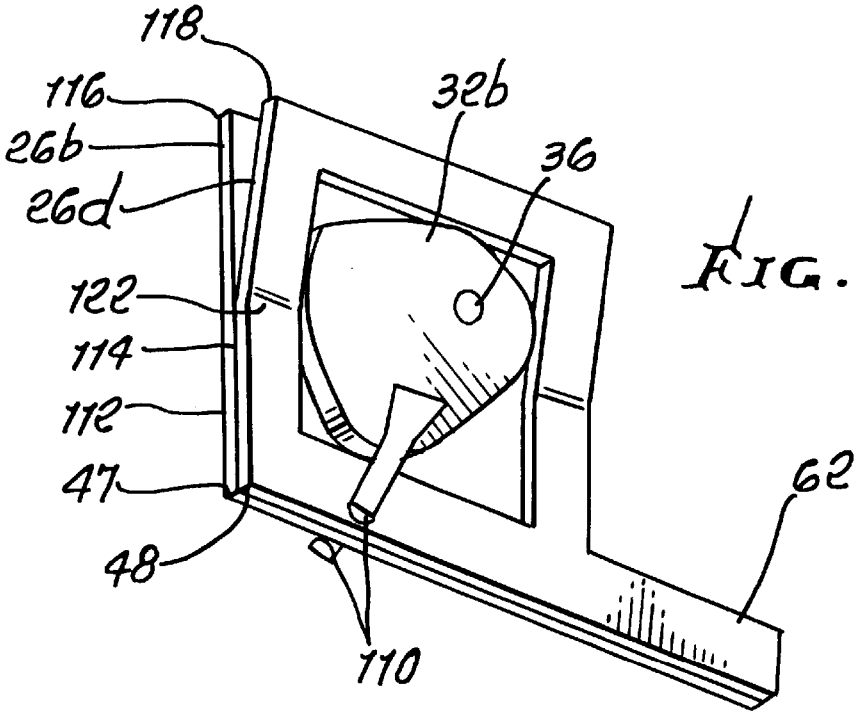
FIG. 9.

DIRECT ACTING CAM GRIPPING MECHANISM

BACKGROUND

1. Field of Invention

This invention relates to gripping devices, specifically to an improved mechanism to depilating devices and particularly directed to improved mechanism for clamping and lifting articles such as in plucking hair or other articles.

BACKGROUND

2. Discussion of Prior Art

Many devices described in prior art such as rotating discs, rotating coiled springs and similar devices catch hair substantially sideways and parallel to the skin tearing at the hair socket sideways producing pain. The sideways action also risk breaking the hair at the base instead of pulling it out with the root bulb. Many such devices catch lumps of hair simultaneously, producing pain. Many such devices close gradually resulting in partial pull on the hair prior to complete closure resulting in failure to catch short hair because by the time it closes it already traveled away from the base of the stem and also in sheering the hair shaft of long hair by pulling on it far away from the stem. Manual tweezers work very well because they close completely prior to pulling, pull perpendicular to skin, pull fast reducing pain, especially when the plucking is done quickly so as to exceed the reaction time of the sensory nerve.

A search in the United States Patent Office has revealed the following:

| PATENT NO. | INVENTOR | ISSUED |
|---|---|---|
| 1,991,816 | Moseley | Feb. 19, 1935 |
| 2,010,988 | Harrison | August 13, 1935 |
| 2,082,263 | Schleimer | Jun. 1, 1937 |
| 2,113,962 | Moir | Apr. 12, 1938 |
| 2,123,870 | Wehmer | July 17, 1938 |
| 2,533,801 | Heilig | December 12, 1950 |
| 2,592,484 | Smith | April 8, 1952 |
| 2,704,857 | Fisher | March 29, 1955 |
| 5,108,409 | Demeester | April 28, 1992 |
| 5,176,690 | Gross et al | Jan. 5, 1993 |
| 5,217,469 | Dolev | Jun. 8, 1993 and |
| 0287976 | The European Patent Office October 1988 | |

As explained below, power operated tweezers described in prior art fail to preserve the advantages of manual tweezers while automating. The advantages of manual tweezers are not completely realized by the previously described prior art power-operated tweezers, because of the complicated construction and/or the inability of the device to pluck the hair at a sufficiently high speed to reduce or eliminate the pain.

In addition, most of the power-operated tweezers devices include but a single pair of jaws which makes the use of the device a slow and tedious operation.

An example of multiple tweezers, as in Dolev U.S. Pat. No. 5,217,469 Jun. 8, 1993 have been mounted on a rotating head and made to open and close by passing through a pair of rollers but they pull the hair sideways loosing the advantage of tweezers all together.

Another example of multiple tweezers is found in Gross, U.S. Pat. No. 5,176,690 Jan. 5, 1993 utilizes an eccentric to reciprocate a block, a separate linkage for closing the tweezers and a third lost-motion mechanism to provide a dwelling action Other power-operated tweezers was found in the patent office are:

A solenoid and a wedge operate on a forceps as in Moseley U.S. Pat. No. 1,991,816 Feb. 19, 1935

An oscillating diaphragm and a series of linkages operating on a forceps as in Schleimer, U.S. Pat. No. 2,082,263 Jun. 1, 1937

A solenoid and a wedge operate on a forceps as in Wehmer, U.S. Pat. No. 2,123,870 Jul. 19, 1938 and a simple camming action have been utilized by Heilig, U.S. Pat. No. 2,533,801 Dec. 12, 1950 to close and then retract a pair of manual tweezers but is very slow and does not lend itself to automation.

A reciprocating cam, a stationary wedge, and a separate wedge operate on a pair of tweezers to close as they are pressed against the skin as in Smith, U.S. Pat. No. 2,592,484 Apr. 8, 1952

A reciprocating cam and a combination of linkages to first close a set of tweezers then retract them all at once has been described by 0287976 October 1988 in the European Patent Office The following four power-operated tweezers are more relevant to the present invention. However, the cam in each of them acts indirectly on the gripping members requiring levers, springs, links, or a separate head to transfer the motion to the gripping members.

Harrison U.S. Pat. No. 2,010,988 Aug. 13, 1935 describes two plates that are slideably connected to each other and pivoted to the housing. One single lobe cam acts on one of the plates to close and open it against the second plate while a second single lobe cam reciprocates the combination of the two plates. Motion is indirectly transmitted from cam to a yoke to a block or a link which in turn move the gripping plates.

Moir, U.S. Pat. No. 2,113,962 Apr. 12, 1938 utilizes a rotatable spindle that has two cams, one continuous inclined groove to reciprocate a slideable plunger, and an arcuate flange inside the spindle to open one of two jaws mounted on the plunger and held together by a pivot and a spring. This design indirectly acts upon the jaws, the spring and the pivot are necessary for the operation, and this design cannot be used for multiple tweezers configuration.

Fisher, U.S. Pat. No. 2,704,857 Mar. 29, 1955 describes a single cam is so arranged for reciprocating jaws and moving same into gripping. This design is not as simple as it seems, in addition to the compound cam one jaw is shaped like a carriage and forms the lower jaw, and the second jaw is pivoted to the carriage and urged open by a spring while an additional lever is pivotally mounted to the sidewall of the carriage and has two rollers; one roller is actuated by the cam and the second roller closes the upper jaw. More than one part is necessary to transfer the cam's motion into the gripping tips.

Demeester, U.S. Pat. No. 5,108,409 discloses a pair of blades mounted on a head that is reciprocated perpendicular to the skin by one mechanism which is an eccentric drive and a yoke or a drive arm. A second and separate mechanism consists of two actuator strips, a spring and a roller to close and to open the gripping blades.

Each of these references is subject to the disadvantages discussed above. Thus, none of the prior art depilatory devices have been entirely satisfactory.

OBJECTS AND ADVANTAGES

Accordingly, besides the objects and advantages of the direct-acting cam gripping mechanism described in this present patent, several objects and advantages of the present invention are:

simple in construction with fewer moving parts plucks hair substantially perpendicular to the skin pulls out substantial number of hairs, over a wide area, one at a time plucks very short hair by catching hair at its base cam follower plate dwells during closing, completely closes before lifting, sweeps along skin surface to prepare the hair for plucking to straighten hair and avoids taking clumps of hair, prepare the skin for plucking, by stretching to avoid pinching, and holding down to avoid hurting.

One distinctive advantage of this invention is that the motion of the cam is transferred directly to the gripping members.

Another particular advantage of this invention is to provide an improved gripping mechanism where at least one pair of gripping surfaces is located on at least one cam follower plate that is situated to be directly acted upon by a rotating cam in such a manner that the rotating cam provides reciprocating motion up and down to and from an operating surface, sweeping forward motion along the operating surface, and a lateral actuating force that in cooperation with at least one actuating surface provides actuating motion to open the pair of gripping surfaces while approaching the operating surface, and to close the said gripping surfaces prior to lifting away from the operating surface.

SUMMARY

Basically, the present invention is an improved gripping device, particularly for gripping and removing unwanted hair from human skin, comprising a rotating cam mechanism which directly acts upon a cam follower plate to reciprocate, sweep along the skin surface, and in cooperation with an actuator, open and close a pair of gripping means to pluck hair or other objects perpendicularly from an operating surface.

DESCRIPTION OF DRAWINGS

Further features and advantages will be apparent from the following description of the appended drawings shown by the way of examples, in which:

FIG. 5 is a perspective view of a device similar to that shown in FIG. 4.

FIG. 6 is a perspective view of a device similar to that shown in FIG. 4.

FIG. 7 depicts a perspective view of a device utilizing the mechanism of FIG. 4 and a pair of plates following the cam.

FIGS. 8*a–g* show a device similar to that depicted in FIG. 7, where the actuator is on the cam, and also show design details of the actuating wedges that are formed from the cam.

FIG. 9 represents another device constructed according to the present invention where the opening and closing is achieved by the same actuators.

Figure 1:
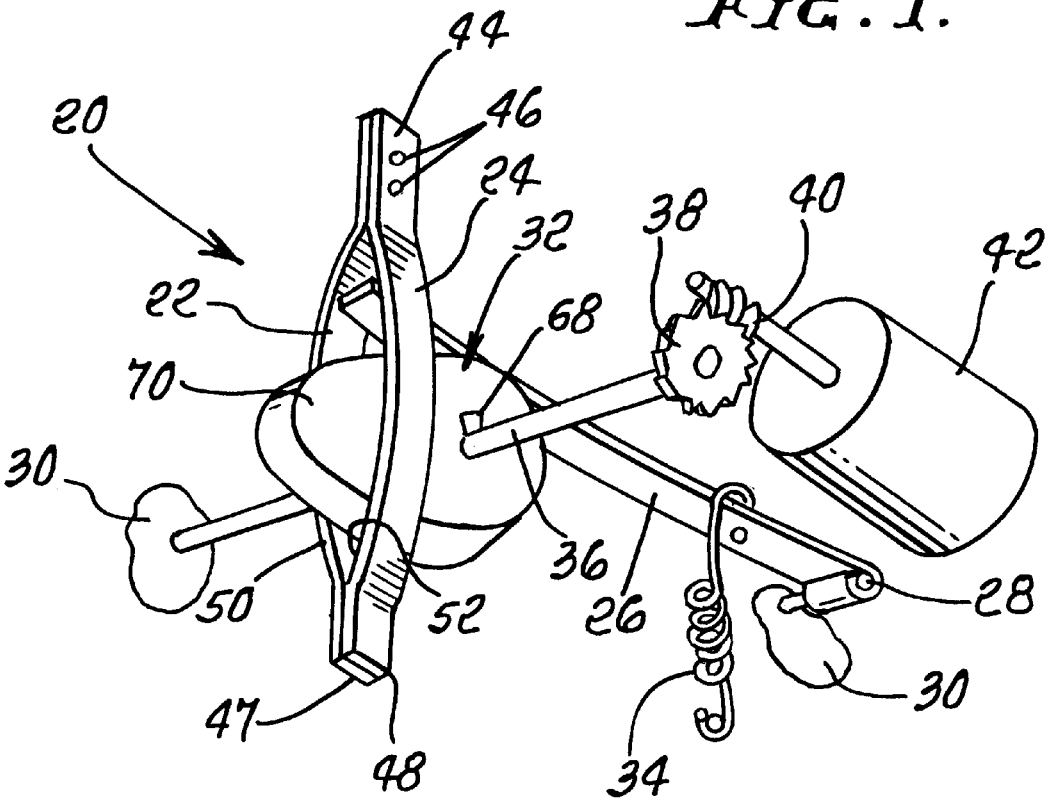
FIG. 1 is a perspective view of one embodiment of the present invention.

LIST OF REFERENCE NUMBERALS 22 and 24 gripping members
26 cam follower plate
28 pivot
30 casing
32 cam
34 spring
36 shaft
38 gear
40 worm gear
42 motor
44 one end of gripping members
46 fasteners
47 and 48 gripping surfaces
50 and 52 inner sides of gripping members
54 fasteners
56 bend at follower
58 wedge actuator means
62 stabilizing arm
64 square opening
66 actuator block
68 key
70 cam lobe
72 arrow
74 front surface
76 upper surface
78 back surface
80 front arm
82 top arm
84 lower portion
86 cavity
88 lower arm
92 free end of the stabilizer arm
94 and 96 edges of the follower members
98 and 99 inclined surfaces
102 wedge
104 narrow cavity
106 wide cavity
108 cam portion
110 pair of cam portions
112 and 114 lower portion of cam follower plates
116 and 118 upper follower portions
122 middle line
124 wide riser edge
126 narrow riser edge
128 tuft of brush bristles
130 cam follower member
134 right plate
136 elongated hote
138 top bar
140 upper follower surface
142 left plate
144 bottom bar
146 bottom follower surface
152 cam follower members
154 stabilizer member
156 rigid gripping member
158 flexible gripping member
160 cam follower surface
162 and 164 tips
166 and 168 stretcher
170 brush wheel
172 comb

DETAILED DESCRIPTION OF THE INVENTION

In general, the present invention describes a mechanism comprising a pair of gripping members mounted on a plate or a cam follower plate, the plate is positioned directly on a rotating cam where the cam reciprocate, sweep, and actuate the gripping members. That mechanism appear in various modifications, in the following forms, chosen for purposes of illustration.

Figure 2:
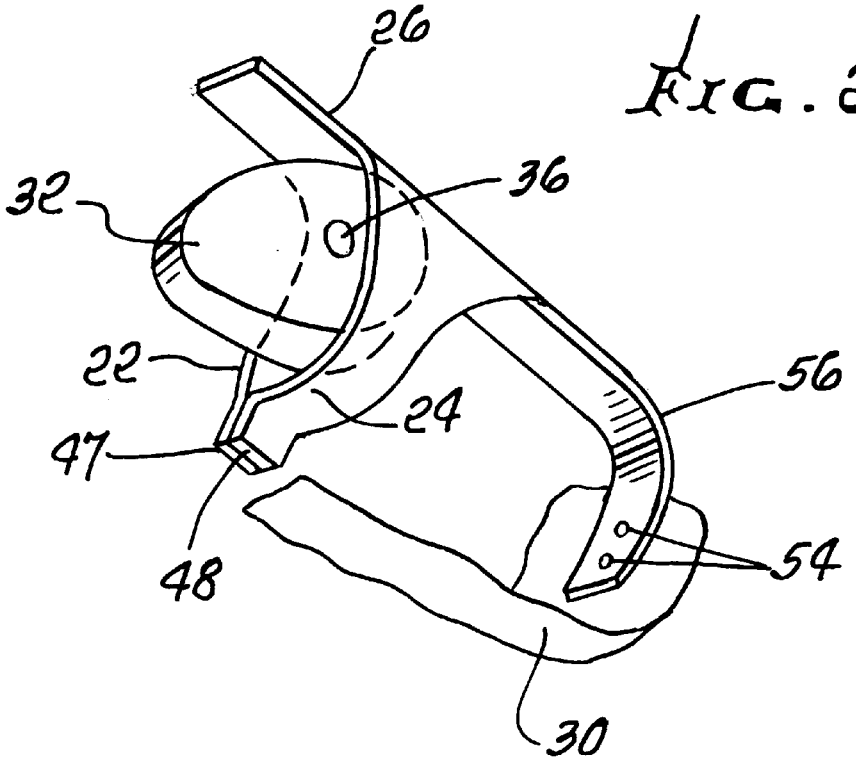
FIG. 2 shows a perspective view of an apparatus similar to that in FIG. 1.
Figure 3:
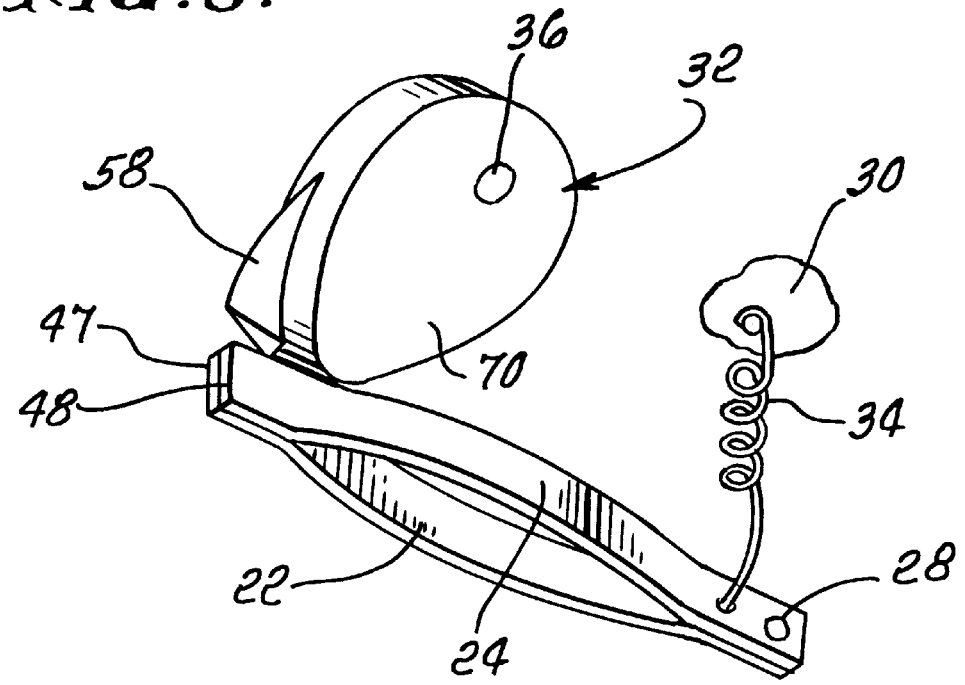
FIG. 3 depicts a perspective view of another apparatus similar to that in FIG. 1.

FIGS. 1–3 show a mechanism 20 comprising a single lobe cam and a pair of tweezers urged closed and also urged into contact with the cam whereas the cam reciprocate the tweezers and passes in between the tweezers to open them and, after the cam passes, the tweezers are closed by their own resiliance. FIG. 1 shows a mechanism indicated at 20 comprising a pair of gripping members 22 and 24 attached together at one end 44 with some fasteners 46 and urged toward each other to be closed by the resilience of their material so as to force a pair of gripping surfaces 46 and 48 to be normally closed with sufficient force to grasp a hair or the like, not shown, between the gripping surfaces 46 and 48. A cam follower plate 26 is attached to one of the gripping members 22 and extends rearwardly from the gripping member 22 to be pivotally attached by a pivot 28 to the casing 30. A single lobe cam 32 is positioned immediately adjacent to both the gripping members 22 and 24 and the cam follower plate 26. The cam 32 is rotatably mounted on a shaft 36 which is rotatably mounted on the casing 30 at one end. The shaft 36 has a gear 38 at the other end. The gear 38 is driven by a motor 42 through a worm gear 40. A spring 34 is attached to the cam follower plate 26 and to the casing 30. The gripping members 22 and 24 are shaped to form two inclined surfaces 50 and 52 on the their inner sides. Preferably, a key 68 will be provided to ensure simultaneous movement of cam 32 with the shaft 36.

In use, as the cam 32 rotate, it passes between the gripping plates 22 and 24 whereby pushes open such plates. As the cam 32 continues to rotate, it will pass the inclined surfaces 50 and 52 and allow the resilience of the gripping members 22 and 24 to close the gripping surfaces 47 and 48 to grasp a hair or the like located in between them. Continued rotation of the cam 32, will slide the cam lobe 70 against the cam follower plate 26 to raise such plate and the gripping members 22 and 24 to pluck the hair or the like from the skin surface, not shown. Additional rotation will allow the spring 34 to return the cam follower plate 26 and the gripping surfaces 47 and 48 into contact with the skin surface.

FIG. 2. Shows a modification of the mechanism 20 shown in FIG. 1 where the tweezers are made of one piece of resilient material such as steel and bent to form two gripping members 22 and 24 to urge the gripping surfaces 46 and 48 to be normally closed. The gripping members 22 and 24 are continually connected to the cam follower plate 26 which is bent at 56 and then attached to the casing 30 with fasteners 54. The shape of the cam follower plate urges the same into continuous contact with the cam 32. The operation is similar to that of mechanism 20 in FIG. 1.

FIG. 3 shows another modification of mechanism 20 shown in FIG. 1, where the cam follower plate 26 is replaced with gripping members 22 and 24 which is pivotally secured to the base 30 by suitable means such as pin 28. The cam 32 is positioned in slideable contact with gripping members 22 and 24 and carries an actuator means 58 which is a wedge or a secondary cam portion of cam 32. A spring 34 is attached to the casing 30 and to the gripping members 22 and 24 at a point near the pivot pin 28.

In use, as the cam 32 is rotated by shaft 36, the lobe 70 will force the gripping members 22 and 24 to move down into contact with the skin then the actuator means 58 will be caused to pass between the gripping members 22 and 24. This action will move the gripping members away from each other to release and sweep any previously plucked hair or article and to allow new hair, or other articles to be inserted between the gripping surfaces 47 and 48. Continued rotation of the cam 32 moves the actuator means 58 out from between the gripping surfaces 47 and 48, allowing the resilience of the gripping members 22 and 24 to cause the gripping surfaces 47 and 48 to engage and grip any hair, or the like which has entered between them. Further rotation of cam 32 causes the lobe 70 of cam 32 to move away from the gripping members 22 and 24 allowing spring 34 to raise the gripping members 22 and 24 and the gripping surfaces 47 and 48 with the hair or other article gripped therebetween and, thus, to pluck the hair or other article from the underlying surface, not shown.

Figure 4:
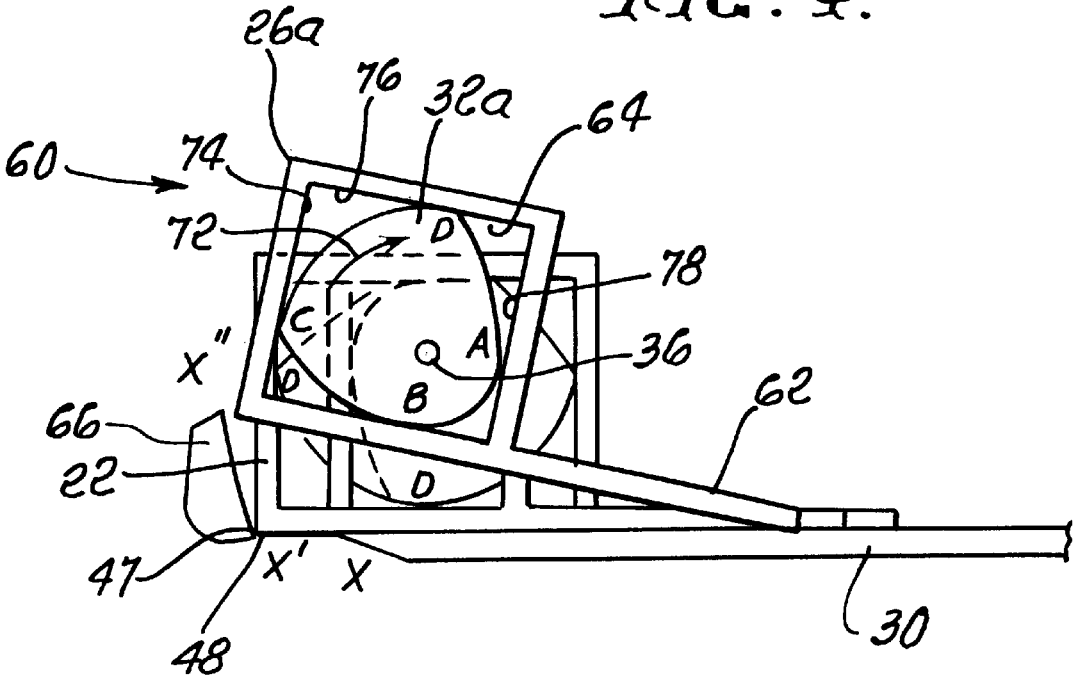
FIG. 4 is a diagrammatic view of a second embodiment of the present invention utilizing a square-path mechanism.

FIG. 4. Shows a square path motion cam mechanism indicated at 60 for converting rotary into rectangular motion. The mechanism 60 comprises a rotatable shaft 36 carrying a cam 32*a* which is rotatable within a square opening 64 of cam follower member 26*a* to allow the follower member 26*a* to move into is and out of gripping engagement with an actuator block 66, fixedly mounted on the base 30. A cam follower plate 26*a* is positioned to move at the same plane of motion of the cam 32*a* but is constrained not to rotate with the cam 32*a* by a stabilizing arm 62. Said cam follower plate 26*a* is provided with a square opening 64 of a size that allows the cam 32*a* to rotate within said opening. A stabilizing arm 62 extends from the cam follower plate 26*a* to slide against the casing 30

The cam 32*a* has a constant breadth cam 32*a* that is constructed as follows: a plate cam 32*a* has two concentric arcs AB and CD both concentric with the center of the rotating shaft 36 and where arc CD has a radius larger than arc AB by the amount of displacement desired for displacing any gripped object. A third arc DA is centered at point C at arc CD and drawn tangential to arc AB at point A and continues until it intersect arc CD at a point D. A fourth arc BC is centered at point D and connects tangentially to arc AB at point B and intersects arc CD at a point C. In this manner, it is clear that this cam 32*a* is a constant breadth cam measuring the same diameter across the center of the shaft 36.

As will be seen, rotation of the shaft 36 causes the follower plate 26*a* to travel a rectangular path, moving into gripping engagement with actuator block 66 to capture a hair or any article, then upward while in gripping engagement, then away from actuator block 66 to release any article gripped between block 66 and the follower member 26*a*, and finally moving downward to its original position. In use, starting with the follower plate 26*a* located in the positions where the fore corner is located at position X and rotating shaft 36 in the direction of arrow 72, it will be seen that the riser AD of cam 32*a* will slide along front surface 74 of opening 64 of the follower plate, causing the follower plate 26*a*, thus, point X to slide to the left into position X', into gripping engagement with actuator block 66 attached to the casing 30. Obviously, any hair, object or the like situated between actuator block 66and follower plate 26*a* will be strongly gripped between the gripping surfaces 47 and 48.

Thereafter, the riser AD of cam 32*a* will slidably rotate along the upper surface 76 of opening 64, whereupon cam 32*a* will push upward, driving opening 64 and point X' to the position X" this upward movement will serve to slide the gripping surface 48 against gripping surface 47 of actuator block 66, in continuing gripping engagement. This will serve to pluck out any hair or other article gripped between gripping surfaces 47 and 48.

Continued rotation of shaft 36 and cam 32*a* will cause riser AD to slide along back surface 78 and point X' to the right to move follower plate 26*a* away from actuator block 66 and to release any article previously gripped between the gripping surfaces 47 and 48. Finally, continued rotation of shaft 36 returns cam 32*a* and point X to its original position.

It is worthwhile to note that as the cam 32*a* rotate, the cam follower plate 26*a* dwells in the down position while gripping surfaces 47 and 48 close, and dwells in the closed position while gripping member 22 lifts perpendicular to the skin surface to pluck hair or the like.

During rotation, stabilizing arm 62 slides along the casing 30 and prevents the cam follower plate 26*a* from rotation with the cam 32*a*.

FIG. 5 shows an alternative form of the mechanism 60 shown in FIG. 4, where the cam follower plate 26*a* is made from a resilient material and the front arm 80, which is the gripping member 22, is resiliently hinged to the top arm 82 and where the lower portion 84 of the front arm 80 is shaped to fit into a cavity 86 carved from the lower arm 88 of the cam follower plate 26*a* to allow the gripping surface 48 to be normally urged open with respect to the gripping surface 47. As in mechanism 60 shown in FIG. 4, cam 32*a* is rotatably mounted on shaft 36 and cam 32*a* rotates within a square opening 64 in cam follower plate 26*a*. Stabilizing arm 62 extends from cam follower plate 26*a* and slides against casing 30.

In use, as the cam 32 rotates, gripping members 47 and 48 will be lowered into contact with the skin surface while in the open position, continued rotation will cause gripping members 47 and 48 to close against the resilience of the front arm 80, and after lifting and plucking hair or object, the resilience of the front arm 80 will cause the gripping members 47 and 48 to open again and be ready to repeat the cycle.

FIG. 6. show another alternative form of the mechanism 60 having a gripping member 24 hingedly mounted on the cam follower plate 26*a* and having its lower end 84*a* normally urged outward by suitable means, such as spring, not shown. A stopper block 66*a* is fixedly attached to the casing 30 and is positioned to limit the forward motion of cam follower plate 26*a*. A stabilizing arm 62 extends from cam follower plate 26*a* and slides against casing 30.

In use, this form of the present invention functions in substantially the same manner as described above with respect to FIG. 4. As the follower 26*a* is driven to the left, by rotation of shaft 36 and cam 32*a*, the gripping member 24 will engage actuator block 66*a*, which will force the gripping member 24 to close, despite the action of spring, to grip any article located between gripping surfaces 47 and 48. In this instance, actuator block 66*a* may be adjustably mounted on the base 30 and serves to ensure the desired gripping tension of the gripping members 22 and 24.

FIG. 7. show another mechanism 90 which is an alternative form of the mechanism 60 shown in FIG. 4, wherein two cam follower members 26*b* and 26*c* are joined at the free end 92 of the stabilizer arm 62 and where the leading edges 94 and 96 of the follower members 26*b* and 26*c* are inclined outwardly. Similarly, actuator block 66*b* is provided with a pair of spaced inwardly inclined surfaces 98 and 100. A wedge 102, which slides into a narrow cavity 104, forces the two follower members away from each other to open the gripping surfaces 47 and 48. Wide cavity 106, which is larger in width than wedge 102, is jointly adjacent, and to the rear of, narrow cavity 104.

In use, as the rotation of cam 32*a* drives the follower member 26*b* and 26*c* downward toward the bottom of casing 30, the wedge 102 slides into cavity 104, forcing the gripping members 26*b* and 26*c* apart. As cam 32*a* continues to rotate, follower member 26*b* and 26*c* are pushed forward, relocating wedge 102 from cavity 104 to the larger cavity 106, then toward actuator block 66*b*, where the inclined surfaces 98 and 99 of the actuator block 66*b* serve to force the inclined leading edges 94 and 96 of the gripping members 26*b* and 26*c* toward each other, thus, the allowing the gripping surfaces 47 and 48 to clamp a hair or other article placed there-between Further rotation of cam 32*a*, will lift the gripping members 26*b* and 26*c* thus plucking the hair or other article.

Figure 8A:
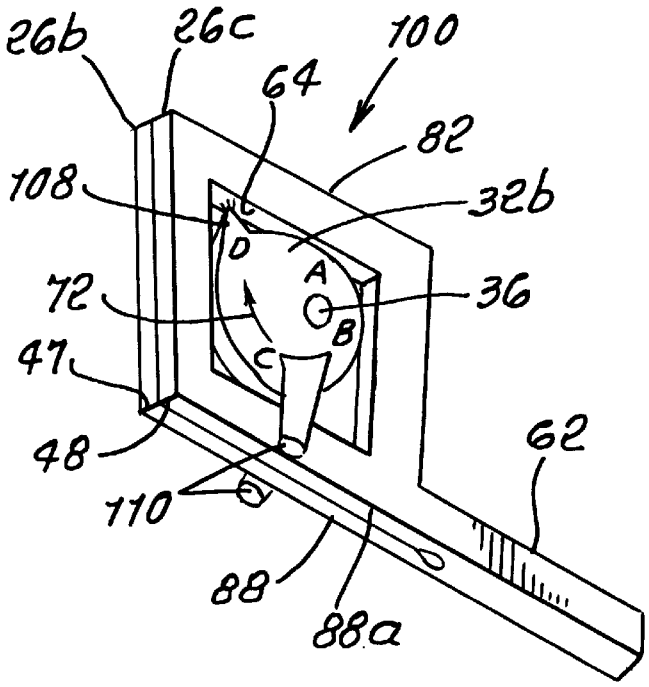
Figure 8B:
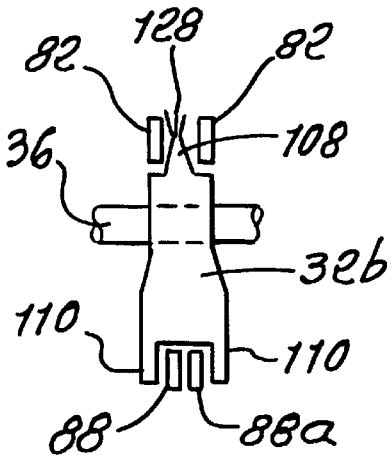

FIGS. 8*a–g* Show a mechanism indicated at 100 similar to that depicted in FIG. 7, where the cam follower plates 26*b* and 26*c* is acted upon by two inputs, the rotation of the shaft 36 and the axial position along the same shaft. The cam 32*b* utilized in this mechanism is a 3-D cam, a combination cam, or a space cam that provides sweeping along skin surface, closing and opening of gripping members, and, lifting of gripping members. As seen in FIGS. 8*a* and 8*b*, a pair of cam follower plates 26*b* and 26*c* each has a square opening 64 and both are joined together at a stabilizer arm 62. Cam 32*b* rotates within square opening 64 and has a cam portion 108 extending from the middle of the edge of cam 32*a* at the riser DA, a pair of cam portions 110 extends from the outsides of cam 32*b* at the riser portion CB of the cam 32*b*. A tuft of brush bristles 128 in attached to the tip of cam portion 108. Lower arm 88 and 88*a* are slightly greater in thickness than the balance of cam follower plates 26*b* and 26*c* to allow ease of rotation of cam portions 110.

Figure 8C:
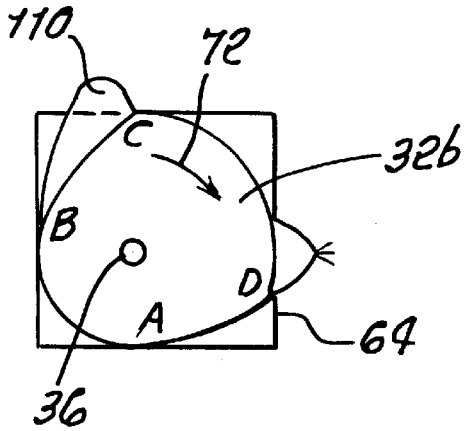
Figure 8D:
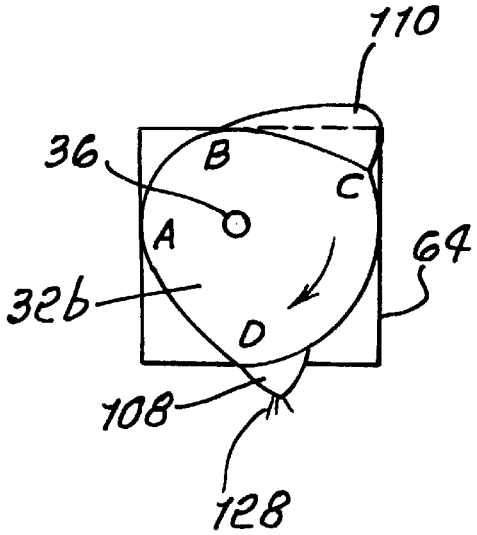

In use, the rotation of the shaft 36 rotates cam 32*b* within square opening 64 of cam follower plates 26*b* and 26*c* in the direction of the arrow 72. As seen in FIG. 8*c*, cam portion 108 begins to be inserted in between lower arms 88 and 88*a* of cam follower plates 26*b* and 26*c* thus opening them and the gripping surfaces 47 and 48. Continued rotation will allow cam portion 108 to sweep between lower arms 88 and 88*a* of cam follower plates 26*b* and 26*c* allowing brush tuft 128 to sweep away any previously plucked hair or the like, and to brush forward any new hair or the like coming into position to be plucked so as to allow a clean grip of the lower portion of the hair stem. As rotation continue, cam portion 108 will slip away from between lower arms 88 and 88*a*. Further rotation will bring the pair of cam portions 110 into outside contact with the lower arms 88 and 88*a* thus closing the gripping surfaces 47 and 48 capturing hair or the like therebetween, immediately following the capture of hair or the like, the riser CA begins to raise the cam follower plates 26*b* and 26*c* thus, the gripping surfaces 47 and 48 perpendicularly away from skin plucking the hair or the like. Not shown here is any adjacent cam follower plates or the casing portion immediately adjacent to the hair or the like, which will retain the skin down while the cam follower plates 26*b* and 26*c* are being lifted up. After the cam follower plates 26*b* and 26*c* are completely lifted up, as seen in FIG. 8*g*, the pair of cam portions 110 slips away from lower arm 88 and 88*a* ending the grip on the gripping surfaces 47 and 48.

FIG. 9 shows a mechanism similar to that in FIG. 8 where there is no need for cam portion 108 for the opening of the cam follower plates 26*b* and 26*d*. While the closing of the cam follower plates 26*b* and 26*d* is done by passing of cam portions 110 over the lower portion of cam follower plates 112 and 114, the opening is accomplished by having one of the parallel plates bent along the middle line 122 producing an uneven placement of the two plates next to each other in such a manner that as the cam rotate, the actuating cam portions 110 pass over the upper portions 116 and 118 forcing the opposite sides 112 and 114 to open.

Figure 10A:
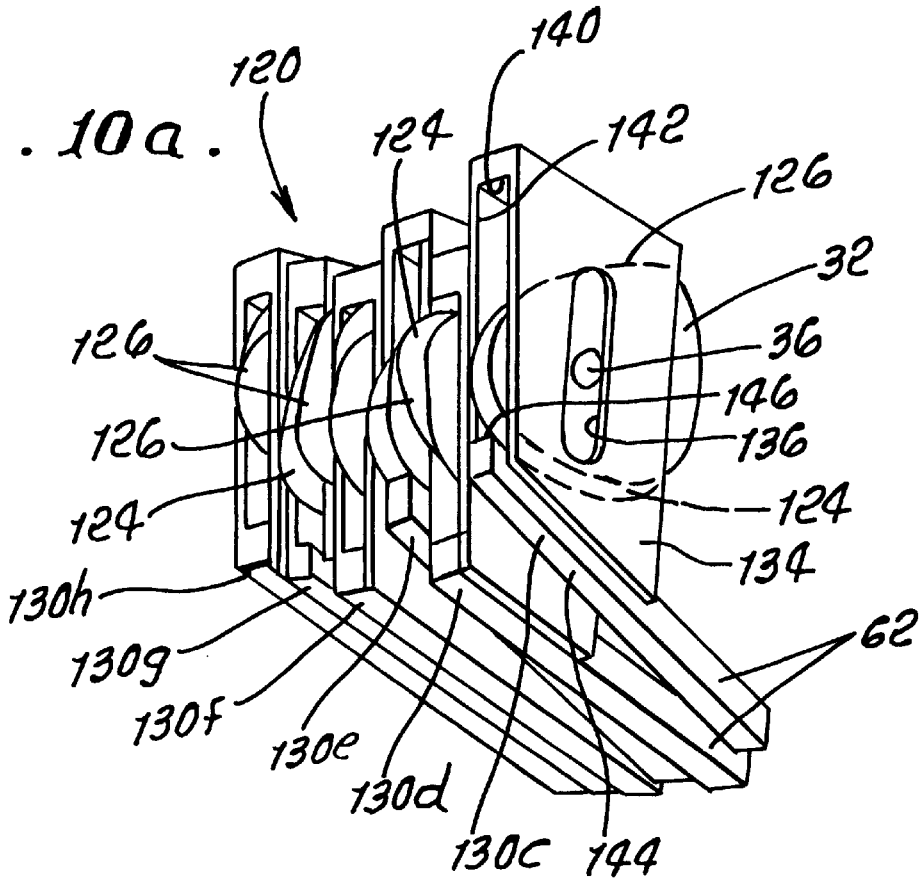
FIGS. 10*a* and *b* show a device with multiple parallel plates where adjacent cams provide the actuation.
Figure 10B:
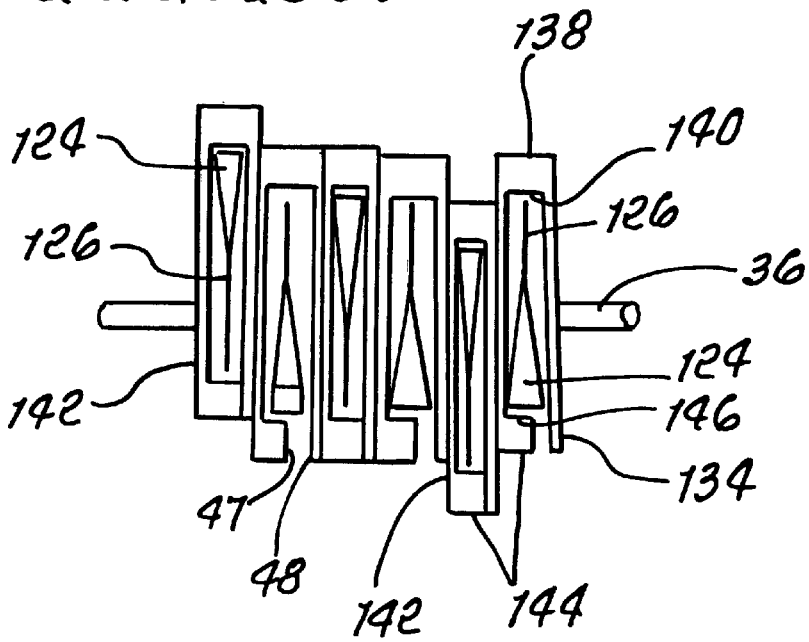
Figure 11:
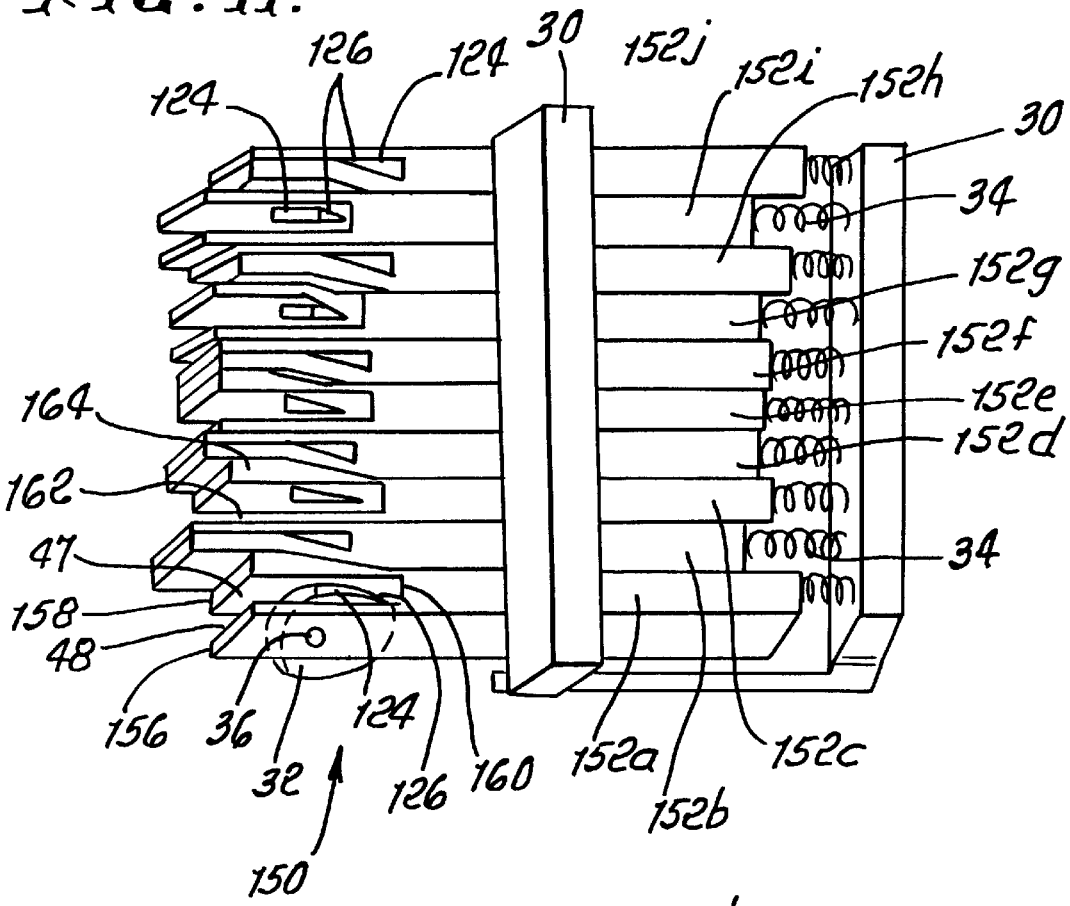
FIG. 11 depict a modified form of the device of FIG. 10

FIGS. 10*a* and *b* show a mechanism indicated at 120 that is a modification of mechanism 90 as depicted in FIG. 8 where the axial displacement of the gripping members 22 and 24 is performed by the two adjacent cams instead if the cam portions 110 as shown in FIG. 8. Mechanism 120 comprises a rotatable shaft 36 carrying two alternating sets of multiple cams 32 where each cam 32 is shaped to have a wide riser edge 124 and a narrow riser edge 126 and where the first set of cams, represented by cams 32*c*, 32*e*, and 32*g*, is staggered so that the leading edge D of cam 32*e* is rotationally ahead, by few degrees, of edge D of cam 32*c* and similarly, the leading edge D of cam 32*g* is rotationally ahead of edge D of cam 32*e*. A second set of cams represented by cams 32*d*, 32*f*, and 32*h* is offset by 180 degrees with respect to the first set of cams so as, for example, cam 32*d* would begin to rise upward, while adjacent cams 32*c* and 32*e* are at the downward position. Each cam 32 has a cam follower member 130 comprising a right plate 134 having an elongated hole 136 to allow the shaft 36 to pass through. The right plate 134 is connected from the top to a to bar 138 which provides an upper follower surface 140 which is then connected to a left plate 142 similar to the right plate 134 which in turn is connected to a bottom bar 144 providing a bottom follower surface 146. The bottom bar 144 extends to the right to provide the stabilizing arm 62. The lower end of right plate 134. In use, as illustrated in FIGS. 10*a* and 10*b*, rotation of shaft 36 rotates all cams 32*c,d,e,f,g* and *h* simultaneously, FIG. 11 shows a mechanism 150 having multiple cam arrangement similar to that shown in FIG. 10, and having an array of cam follower members 152*a–j*, each comprising of an elongated stabilizer member 154, extending from it a rigid gripping member 156 and a flexible gripping member 158 and a cam follower surface 160 in between the two gripping members 156 and 158, where the tip of gripping member 156 is one quarter of the thickness of cam follower member 152 and the tip of gripping member 158 is one half of the thickness of cam follower member 152 and the flat cam follower surface 160's width equals one half of the thickness of cam follower member 152. Cams in this mechanism 150 are similar to those in mechanism 120 where each cam has a wide riser edge 124 that is approximately one half the thickness of cam follower member 152, and a narrow riser 126 edge that tapers to a zero thickness. Each of the tips 162 and 164 continue for a short distance, at the same thickness, to form the gripping surfaces 47 and 48.

In use, as cam follower members 152*a* and 152*c* begin to move down toward the skin surface, the gripping members 156 and 158 will be fully opened by the wide edge of the cam 124. As a result, the cam follower member 152*b* which is slidably movable in between 152*a* and 152*b*, will be forced closed by the action of the adjacent cams 152*a* and 152*c*. Continued rotation of shaft 36 and cam 32, will cause cam follower member 152*b* to move upward thus plucking the hair or object captured.

Figure 12A:
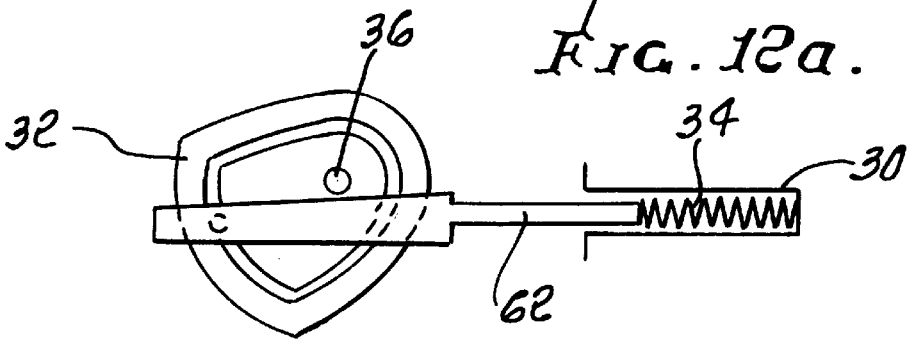
FIGS. 12*a–m* represent variations of some details of the above described configurations.
Figure 12B:
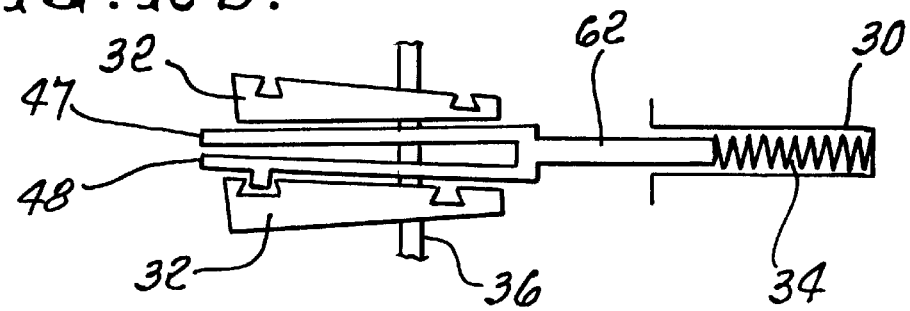

Other embodiments and modifications are shown in FIGS. 12*a–m*; FIG. 12*a* and *b* show another modification where a pair of gripping members are positioned to form a pair of gripping surfaces 47 and 48 at one end and are is attached from the other end to a stabilizer 62 which slides into a groove in the casing 30 and where the cam is a face cam with a groove of a desired shape where a peg extending from the gripping member fits and where the face cam has a flat back surface and a sloped front surface.

In use, as the cam rotate, the groove in the face cam will reciprocate the gripping members, and the variation in the cams thickness will open and close the gripping members.

Figure 12C:
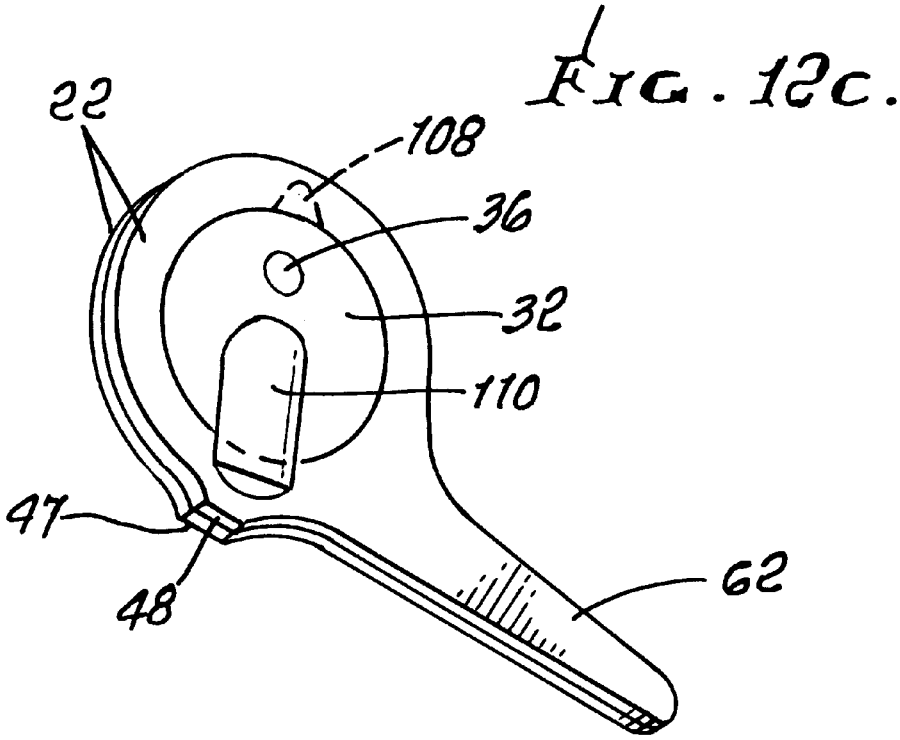

FIG. 12*c* shows a circular eccentric having two secondary cam portions that closes the gripping members which are the lower portion of a circular cam follower plates.

Figure 12D:
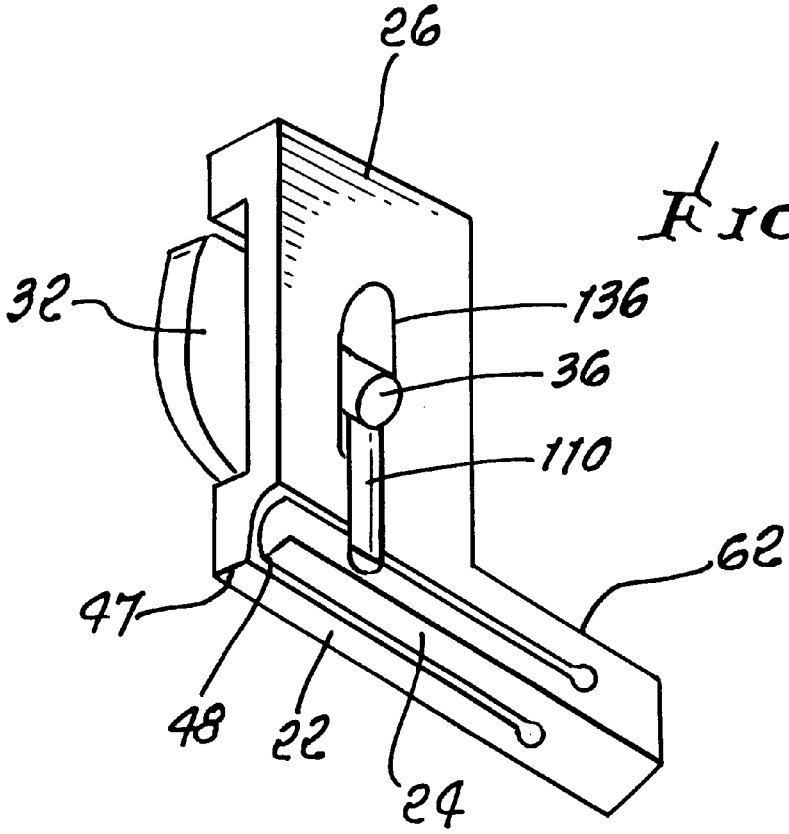

FIG. 12*d* is a modification of mechanism 120 depicted in FIG. 10*a* where the cam follower plate is constrained to rotate between the cam and one actuating cam portion and where gripping member is carved from the lower arm of the cam follower plate. Thus further simplifying the cam follower plate design.

Figure 12E:
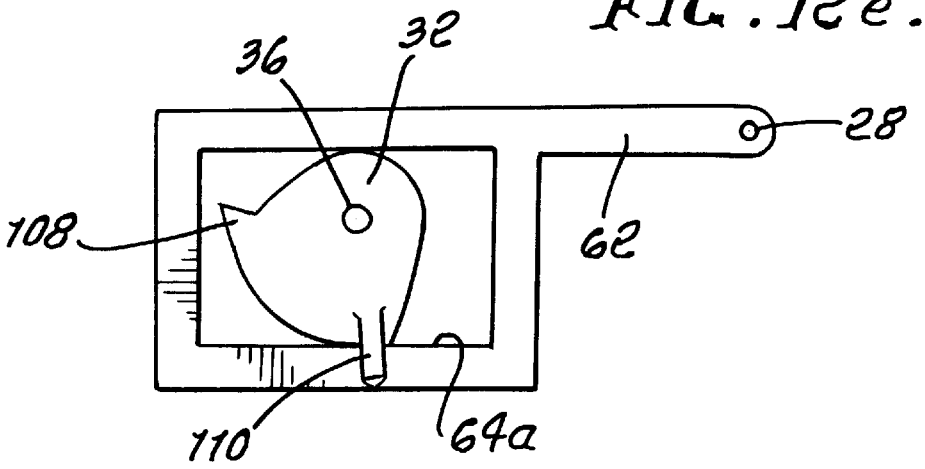

FIG. 12*e* shows a modification of the mechanism 90 as depicted in FIG. 8, where the opening in the cam follower plate is rectangular thus allowing the cam follower plate to be pivotally mounted on the casing 30 by a suitable means such as a pivot 28.

Figure 12F:
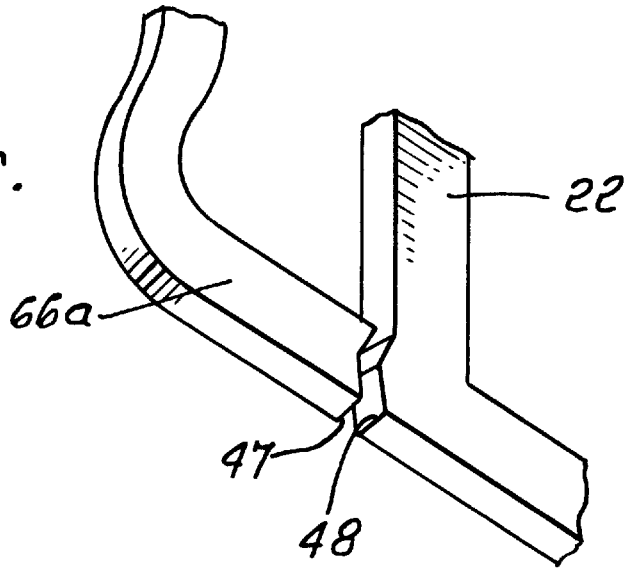

FIG. 12*f* shows an alternative form of the actuator block 66 depicted in FIG. 4, where the actuator block 66a is long flat plate that is a portion of the casing material 30 that flexes up as the gripping member 22 moves upward and while the gripping surfaces 47 and 48 engage.

Figure 12G:
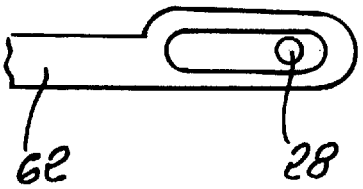

FIG. 12*g* Shows a method of guiding the stabilizer arm by means of an elongated slot and a pin attached to the casing limits its motion.

Figure 12H:
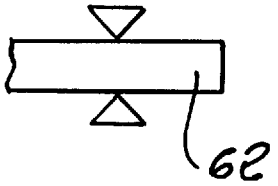

FIG. 12*h* shows a method similar to that in FIG. 12*g* where the guide is two or more pointed pins to limit the motion of the cam follower plate, not shown, in one direction.

Figure 12I:
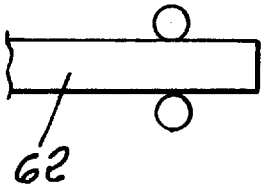

FIG. 12*i* Shows same as FIG. 12*h* where the guide is a pair of round pins.

Figure 12J:
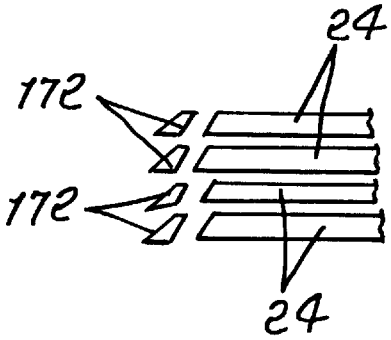

FIG. 12*j* represent a modification of the actuator block 66 depicted in FIG. 4, where, in a multiple gripper arrangement, the actuator blocks are slanted to allow hair or articles to pass in between them to be gripped by the gripping surfaces behind them.

Figure 12K:
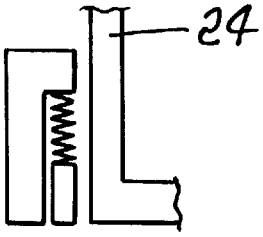

FIG. 12*k* shows another modification of the actuator block 66 depicted in FIG. 4, where, the actuator block is allowed to slide along the casing as the gripping member slide up, and to be returned by the force of a spring.

Figure 12L:
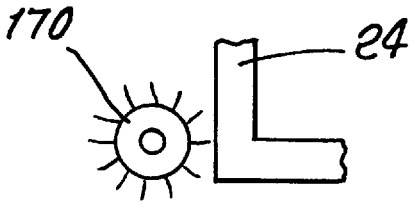

FIG. 12*l* shows an additional brush wheel mounted on an independent drive shaft in front of follower.

Figure 12M:
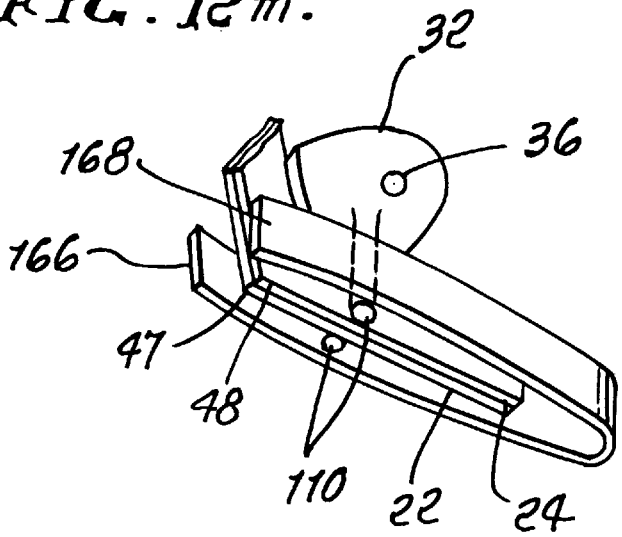

FIG. 12*m* shows an additional pair of plates that would stretch skin sideways prior to clamping of gripping surfaces.

CONCLUSIONS, RAMIFICATIONS, AND SCOPE OF INVENTION

From the above description, it becomes clear that while the mechanism of this invention appear in many variations and offer various advantages, they all share the same basic design features made available by placing the gripping surfaces directly on the cam follower plates and utilizing the cam forces of motion to act upon the cam follower plate in such a manner that the rotating cam provides reciprocating motion up and down to and from an operating surface, sweeping forward motion along the operating surface, and a lateral actuating force that, in cooperation with at least one actuating surface, opens a pair of gripping surfaces while approaching the operating surface, and close the gripping surfaces prior to lifting away from the operating surface.

Thus the reader will see that the gripping mechanism of this invention can be economically manufactured because of it's simple construction, and having fewer parts.

This gripping mechanism is efficient because the cam directly provides all required motions for efficient plucking of hair or other objects, while lifting substantially perpendicular to the skin surface, thus minimizing pain.

While my above description contains many specificities, these should not be construed as limitations on the scope of the invention, but rather as an exemplification of one preferred embodiment thereof. Many other variations are possible. For example it could be made of any suitable material such as steel or plastic.

A comb may be placed ahead of the gripping members and operated by the cam to stretch skin ahead of the gripping members.

The mechanism of the present invention is accurate enough to be used for plucking eyebrows and other facial hair and can be adjusted to pluck fine or course hair or other objects. Said mechanism can also be utilized in other fields such as in material handling and manufacturing.

Accordingly, the scope of the invention should be determined not by the embodiments illustrated, but by the appended claims and their legal equivalents.

I claim:

1. A gripping mechanism comprising a casing, a shaft, a motor mounted within said casing to rotate the shaft, at least one cam having at least one lobe mounted on the shaft for circular motion in a plane normal to the axis of the shaft, a cam follower plate having at least one flat surface positioned to be reciprocated by the cam to and from an operating surface, a stabilizing means for preventing the cam follower plate from rotating with the cam, at least one gripping member being attached to the cam follower plate to form a pair of gripping surfaces and, an actuating means shaped and positioned so as to cooperate with the cam to close and to open the gripping surfaces, the cam and said gripping surfaces being in mutually close proximity to one another, whereby the cam effects both reciprocation of the gripping surfaces toward and away from the operating surface, and opening and closing of the gripping surfaces.

2. A gripping mechanism according to claim 1, wherein the cam is a constant breadth plate cam.

3. A gripping mechanism according to claim 2, wherein said gripping member is formed from the cam follower plate to form the pair of gripping surfaces and where the actuating means is a portion of the casing placed in the path of motion of the cam follower plate so as to close the gripping surfaces prior to and during the cam follower plate being lifted upwardly away from the operating surface.

4. A gripping mechanism according to claim 2, wherein a pair of gripping members are mounted on the sides of the cam to straddle the cam whereby the cam passes in between the two gripping members.

5. A gripping mechanism according to claim 2, wherein a second cam follower plate is positioned parallel to the first cam follower plate to form a pair of gripping members.

6. A gripping mechanism according to claim 5, wherein at least one of said cam follower plates is curved along the horizontal axis in order to allow a leverage action to open and close a gripping members.

7. A gripping mechanism according to claim 2, wherein said actuating means are mounted on the cam so as to close the gripping surfaces prior to and during the cam follower plate being lifted upwardly away from the operating surface.

8. A gripping mechanism according to claim 2, wherein the cam follower plate has a rectangular opening resulting in a vertical reciprocating action only without horizontal sweeping.

9. A gripping mechanism according to claim 1, wherein the cam is a circular eccentric and the cam follower plate is a circular ring plate with an elongated stabilizer arm extended to one side to prevent the cam follower plate structure from rotating with the cam whereas as the cam rotates; the cam follower plate structure reciprocates toward and away from the operating surface and the actuating means close and open gripping surfaces.

10. A gripping mechanism according to claim 1, wherein the cam comprises at least one eccentric lobe, the gripping surfaces are urged closed, and wherein the cam follower plate is attached to the casing, and is urged to follow the cam by resilience means.

11. A gripping mechanism according to claim 1, wherein a pair of gripping members are placed below the cam, pivotably attached to the casing at one end, and urged upwardly away from the operating surface and where the cam pushes the pair of gripping members down until the gripping surfaces are as close as possible to the operating surface; with further rotation of the cam, the actuating means attached to the cam slides in between and separates the gripping members allowing an object to be positioned for plucking; as the cam further rotates, the actuating means slips away from the gripping surfaces allowing a resilient means to close said gripping surfaces gripping the hair in between; and as the cam moves upwardly, a second resilient means moves the gripping members and the gripping surfaces upwardly plucking the object from the operating surface.

12. A gripping mechanism according to claim 1, wherein more than one cam and more than one pair of gripping members are mounted on the same shaft for gripping and retracting in sequence thereby plucking one object at a time over a wide area of the operating surface.

13. A gripping mechanism according to claim 1, wherein there are two adjacent cams which close and open at a desired time coordinated with reciprocation of the gripping surfaces.

14. A gripping mechanism according to claim 1, wherein at least one brush tuft is mounted on the cam to prepare an object for gripping.

15. A gripping mechanism according to claim 1, wherein an additional rotating shaft is provided to drive a set of brushes ahead of the gripping means to prepare an object for gripping.

16. A gripping mechanism according to claim 1, wherein a comb is attached to the casing ahead of the gripping member so as to prepare any objects at the operating surface and the operating surface itself for gripping.

17. A gripping mechanism according to claim 16, wherein said comb is movable by the cam to stretch the operating surface sideways.

18. A gripping mechanism comprising: at least one pair of gripping members directly placed in the rotational path of a three-dimensional cam rotatably mounted on a rotatable shaft, and a motor mounted within a casing for rotating the shaft, whereby as the shaft rotates, the cam lowers the gripping members to an operating surface, sweeps along said surface, opens apart the gripping members, closes said gripping members, then lifts the gripping members substantially perpendicular to the operating surface thus plucking a target object from said operating surface.

19. A gripping mechanism according to claim 1, wherein the cam follower plate has a square opening whereby a constant breadth plate cam turns to result in said cam follower plate moving in a square path motion along the cam's plane of rotation, wherein said stabilizing means is an elongated arm extending rearwardly from the plate and slides along the casing, and wherein said actuating means is a block connected to the casing and directly meeting the cam follower plate to form a pair of said gripping members, whereby said cam follower plate will move down to the operating surface, dwell for a period of time, sweep forward along said surface, dwell, lift away from said surface, dwell, sweep backwardly, dwell, and return down to the operating surface.

* * * * *